US010246992B2

(12) United States Patent
Hansen et al.

(10) Patent No.: US 10,246,992 B2
(45) Date of Patent: Apr. 2, 2019

(54) MULTIPHASE FLUID ANALYSIS

(71) Applicant: Total E&P Danmark A/S, Copenhagen Ø (DK)

(72) Inventors: Jens Henrik Hansen, Copenhagen Ø (DK); Kristian Mogensen, Copenhagen Ø (DK)

(73) Assignee: TOTAL E&P DANMARK A/S, Copenhagen Ø (DK)

( * ) Notice: Subject to any disclaimer, the term of this patent is extended or adjusted under 35 U.S.C. 154(b) by 78 days.

(21) Appl. No.: 15/025,841

(22) PCT Filed: Sep. 24, 2014

(86) PCT No.: PCT/EP2014/070397
§ 371 (c)(1),
(2) Date: Mar. 29, 2016

(87) PCT Pub. No.: WO2015/044220
PCT Pub. Date: Apr. 2, 2015

(65) Prior Publication Data

US 2016/0245073 A1 Aug. 25, 2016

(30) Foreign Application Priority Data

Sep. 30, 2013 (EP) ..... 13186589

(51) Int. Cl.
*E21B 47/10* (2012.01)
*E21B 43/00* (2006.01)
(Continued)

(52) U.S. Cl.
CPC ..... *E21B 47/10* (2013.01); *E21B 43/00* (2013.01); *E21B 43/12* (2013.01); *E21B 47/06* (2013.01)

(58) Field of Classification Search
CPC . G01F 1/74; G01N 2291/02836; E21B 47/10; E21B 43/00; E21B 43/12; E21B 47/06
See application file for complete search history.

(56) References Cited

U.S. PATENT DOCUMENTS 3,834,227 A 9/1974 Patterson et al.
5,148,405 A * 9/1992 Belchamber ..... G01F 1/666 367/13

(Continued)

FOREIGN PATENT DOCUMENTS

EP 1588022 A1 10/2005
GB 2433137 A 6/2007

(Continued)

OTHER PUBLICATIONS

Search Report for European Application No. EP 13 18 6589, completed Feb. 21, 2014.

(Continued)

*Primary Examiner* — Kyle R Quigley
(74) *Attorney, Agent, or Firm* — Brinks Gilson & Lione

(57) ABSTRACT

A method and a system of analyzing multiphase fluid flow in at least one well or pipeline is provided, the method comprises characterizing slug flow in the multiphase fluid flow by receiving a plurality of well pressure data from the at least one well, processing the plurality of well pressure data to obtain a time-varying slug amplitude and/or a time-varying slug period for slugs in the slug flow, analyzing the slug amplitudes and/or the slug periods over a period of time to thereby determine a measure of well performance. Also an oil field monitoring system for an oil field comprising a plurality of wells is provided. Each well has a pressure gauge installed to measure a well pressure and is connected to a multiphase fluid flow analyzing system. An oil field unit receives the measure of well performance from the multi- (Continued)

phase fluid flow analyzing system, and output the measures of well performance for each of the plurality of wells.

19 Claims, 11 Drawing Sheets

(51) Int. Cl.
*E21B 43/12* (2006.01)
*E21B 47/06* (2012.01)

(56) References Cited

U.S. PATENT DOCUMENTS 5,680,899 A 10/1997 Waid et al.
2002/0035551 A1* 3/2002 Sherwin ..... G06Q 10/06 705/412
2003/0225533 A1 12/2003 King et al.
2010/0023269 A1* 1/2010 Yusti ..... E21B 43/00 702/12
2010/0076693 A1* 3/2010 Liang ..... G05B 23/0229 702/22
2011/0023626 A1* 2/2011 Weinstein ..... G01F 1/74 73/861.357
2012/0095733 A1* 4/2012 Rossi ..... E21B 43/00 703/2
2012/0298421 A1* 11/2012 Coates ..... E21B 47/182 175/50

FOREIGN PATENT DOCUMENTS

WO 9745716 A1 12/1997
WO 2004057153 7/2004
WO 2009133343 A1 11/2009

OTHER PUBLICATIONS

T. Elperin et al., "Flow regime identification in a two-phase flow using wavelet transform", published Apr. 17, 2002.
International Search Report and Written Opinion for PCT/EP2014/070397, dated Jul. 7, 2015.
International Preliminarey Report on Patentability for PCT/EP2014/070397, dated Apr. 5, 2016.

* cited by examiner

MULTIPHASE FLUID ANALYSIS

RELATED APPLICATIONS

This application claims the benefit under 35 U.S.C. § 371 of the filing date of International Patent Application No. PCT/EP2014/070397, having an international filing date of Sep. 24, 2014, which claims priority to European Application No. 13186589.1, filed Sep. 30, 2013, the contents of both of which are incorporated herein by reference in their entirety.

TECHNICAL FIELD

The present disclosure relates to a method and a system for analysing multiphase fluid flow in pipeline systems, such as well systems, such as in oil well systems, such as to provide a measure of well performance. Additionally, a system and a method for oil field monitoring of individual well performance is disclosed.

BACKGROUND

For an oil field, the total daily oil production from the entire field is typically accurately metered for fiscal reasons, however, the production from individual oil wells is not known on a daily basis.

Typically, in an oil field, all oil wells are hooked up to a common production manifold which directs the commingled flow of water, oil and gas from the wells to a number of separators, each operating at distinct pressure and temperature. Thus, oil from numerous different wells is directed to the common production manifold and processed as one commingled flow, irrespective of well origination and thus no information on flow from individual wells is obtainable at the processing stage.

Many oil fields are also equipped with a test separator to which each of the wells can be routed individually to extract information about the present production state of the well being tested. The test results may provide information about well production and may provide input to pipeline simulation models, which are used to simulate the flow in the pipelines and which may be used to simulate different control structures for example to monitor, suppress or control slugging in multiphase fluid flow in pipelines.

Slug flow is a commonly observed pattern in multiphase fluid flow and is characterised as a flow regime with large coherent disturbances which cause large pressure fluctuations and variations in the flow rate which can affect process equipment, may damage the reservoir rock and imposes additional wear on the surface equipment, and which may even overload the capacity of the equipment at the pipeline outlet.

Therefore, simulation tools are often used to characterise the flow and attempt to control or suppress the slug flow, for example by regulating choke settings for the well in accordance with the simulation data. The simulation models typically require input from the well testing to provide reliable results.

Thus, other ways to monitor the wells have been suggested. In U.S. Pat. No. 8,078,328, wellhead pressure data are measured to form an isobaric pressure map of one or more reservoirs and displaying the at least one isobaric pressure map on a display to provide for real-time reservoir pressure monitoring. The pressure map may be overlaid with for example injection rate and cumulative injection for the well and on the basis of this a static reservoir pressure may be estimated.

Furthermore, instrumentation, such as multi-phase meters, can be positioned in the wells to provide some real-time information on actual well performance, and for example in EP 1588022, it is suggested to use a densitometer in the well to define the slug based on the measured density. It is further suggested to enhance the densitometer with further instrumentation to register the differential pressure (dP) between the slug detector and the process arrival to provide information on the on-line water cut in combination with the local hold-up or void fraction as well as fluid velocities of the different phases to thereby provide an indication of well performance.

However, such meters require regular maintenance and frequent calibration against test separator data to provide reliable information; testing of a well can only provide for real-time information on well performance for one well at a given point in time, thus other or additional solutions are needed.

SUMMARY

It is an object of the present invention to provide a system and a method overcoming at least some of the deficiencies of the prior art as mentioned above.

According to an aspect of the present invention, disclosed is a method of analysing multiphase fluid flow in at least one well, the method comprises characterising slug flow in the multiphase fluid flow by

- receiving a plurality of well pressure data from the at least one well,
- processing the plurality of well pressure data to obtain a time-varying slug amplitude and/or a time-varying slug period for slugs in the slug flow,
- analysing the slug amplitudes and/or the slug periods over a period of time to thereby determine a measure of well performance, wherein the measure comprises a slug amplitude distribution and/or a slug period distribution over the period of time and/or wherein the measure comprises a slug amplitude average and/or a slug period average.

According to an aspect of the present invention, disclosed is a system for analysing a multiphase fluid flow in at least one well transporting multiphase fluids, each well having at least one pressure gauge configured to measure well pressure, the system comprises

- a processor for receiving well pressure data and configured to process the well pressure data to obtain a time-varying slug amplitude and a time-varying slug period for slugs in the multiphase fluid flow, and analysing the time-varying slug amplitudes and/or the time-varying slug periods over a period of time to determine a measure of well performance, wherein the measure comprises a slug amplitude distribution and/or a slug period distribution over the period of time and/or wherein the measure comprises a slug amplitude average and/or a slug period average.

According to an aspect of the present invention, a method of analysing multiphase fluid flow in at least one well forming part of a well system is provided. The method comprises characterising slug flow in the multiphase fluid flow by receiving a plurality of well pressure data from the at least one well, processing the plurality of well pressure data to obtain a slug amplitude, such as a time-varying slug amplitude, and/or a slug period, such as a time-varying slug period, for slugs in the slug flow. The method may furthermore comprise analysing the time-varying slug amplitudes and/or the time-varying slug periods over a period of time to thereby determine a measure of well performance.

According to a further aspect of the present invention, a system is provided for analysing multiphase fluid flow in at least one well forming part of a well system comprising one or more wells transporting multiphase fluids, each of the one or more wells having at least one pressure gauge configured to measure well pressure. The system comprises a processor configured to receive and process well pressure data to obtain a slug amplitude, such as a time-varying slug amplitude, and a slug period, such as a time-varying slug period, for slugs in the multiphase fluid flow, and analysing the time-varying slug amplitudes and/or the time-varying slug periods over a period of time to determine a measure of well performance. The processor may receive pressure data from the at least one pressure gauge. A database may be provided for receiving and storing well pressure data from the at least one pressure gauge for the at least one well and the processor may receive the pressure data from the database, or any other intermediate elements.

According to still further aspect of the present invention a well system is provided, the well system comprising one or more wells, each well having at least one pressure gauge installed to measure a well pressure, a common production manifold configured to receive well production output from the one or more wells, a test manifold configured to receive well production output from one of the one or more wells, a fluid flow analysing system as described above and an oil field unit being configured to receive a control signal from the fluid flow analysing system. The oil field unit may be configured to schedule a well for testing in response to the received control signal from the multiphase fluid flow analysing system.

According to a further aspect of the invention, an oil field monitoring system for an oil field is provided. The oil field comprises a plurality of wells, each well having at least one pressure gauge installed to measure a well pressure and being connected to a multiphase fluid flow analysing system as disclosed above, the oil field monitoring system comprising an oil field unit being configured to receive the measure of well performance from the multiphase fluid flow analysing system for each of the plurality of wells, and an interface for outputting the measures of well performance for each of the plurality of wells.

According to an aspect of the invention, a pipeline monitoring or well monitoring system is provided, the pipeline being configured for multiphase fluid flow and has at least one pressure gauge installed to measure a pipeline or well pressure. The monitoring system may comprise a processor configured to receive and process pipeline or well pressure data to obtain a slug amplitude, such as a time-varying slug amplitude, and a slug period, such as a time-varying slug period, for slugs in the multiphase fluid flow, and analysing the time-varying slug amplitudes and/or the time-varying slug periods over a period of time to determine a measure of well performance.

A pipeline controller may be configured to receive the measure of well performance. The monitoring system may further have an interface for outputting the measure of well performance, such as a display.

Furthermore, a computer program comprising program code means for performing the steps of the method as herein described when said computer program is run on a computer is provided, and/or a computer readable medium having stored thereon program code means for performing the method as herein described when said program code means is run on a computer.

It is an advantage of the present invention that a measure of well performance may be obtained on the basis of well pressure measurements. This is especially advantageous as well pressure measurements are easily accessible, thus providing a method of analysing fluid flow and a method of monitoring oil fields and/or individual wells without the need for complex measuring equipment to be installed in the wells themselves.

It is a further advantage that the systems and methods allow for real-time analysis and real-time monitoring of oil wells and/oil fields. It is a still further advantage that, a real-time measure of well performance may be provided.

It has surprisingly been found by the present inventor that even though the slug flow and correspondingly the pressure data received as such are a-periodic and chaotic, a repetitive pattern has been found for the distribution of the time-varying slug amplitude and/or the time-varying slug period over a pre-determined period of time, when the time period comprises numerous slugs. It is a further advantage that the slug distribution patterns may be correlated with well performance.

Multiphase fluid flow in well systems, such as in oil and gas systems, may comprise quite complex flow regimes and slug flow is a commonly observed pattern in multiphase fluid flows. The multiphase fluid may be a two-phase, a three-phase or a four-phase fluid, etc. and the phases may comprise liquids, gases and/or solids, such as oil, gas, water and/or solids, and/or any combination thereof. In a fluid flow comprising liquid and gas, typically, under certain operating conditions, the liquid and the gas are not distributed evenly but travel as "plugs" of mostly liquid or mostly gas, thus, the flow may alternate between areas having a high-liquid content and areas having a high-gas content. These "plugs" may be referred to as slugs. For example, fluids do not necessarily flow at constant rates from a wellbore into a separator, such as a test separator. Oil, water and gas typically move at different speeds in every part of the system and typically further segregation between the phases occurs in vertical parts where the pressure and temperature conditions change more rapidly. Pressure oscillations in the fluid, both at the wellhead and downhole indicate the presence of a slug flow. The pressure fluctuates when the phase and/or composition of the fluid changes. A slug may be characterised by the distance between two subsequent pressure maxima, or between two subsequent pressure minima, as a pressure minimum or a pressure maximum indicates that the composition in the fluid changes.

It has been found that by analysing pressure data from a well, a measure of well performance may be obtained.

Throughout the present disclosure the term well has been used. It is however envisaged that the same method and system may be used for analysing a multiphase fluid flow in any pipelines, such as in wells, such as in oil wells, etc.

The pressure data may be received from anywhere in the well, however, most often downhole pressure data, BHP, or surface pressure data, THP, are received and analysed. Typically, real-time pressure data are logged using any means as known in the art, such as any data logger, data acquisition system, etc., and the real-time pressure data may be stored in a database, the database comprising the received pressure and the time of the pressure measurement.

The system for analysing data may receive data from the database, alternatively, the system may receive the real-time pressure data directly.

The system may comprise an interface for receiving the data. The interface may be configured for extracting the data from the database storing the pressure data. In some embodiments the system may comprise the database.

The processor typically analyses pressure data as measured over a predetermined period of time, the period of time may be more than half an hour, such as more than one hour, such as more than 5 hours, such as more than 10 hours, such as 12 hours, such as more than 12 hours, such as more than 18 hours, such as 24 hours, such as more than 24 hours, such as 48 hours. The predetermined period of time may be between 1 hour and 24 hours, such as between 5 hours and 24 hours, such as between 12 hours and 24 hours, such as between 18 hours and 24 hours, between 6 hours and 18 hours, between 1 hour and 12 hours, such as between 6 hours and 12 hours. In one or more embodiments, the predetermined period of time may be any period of time in which more than 100 slugs are identified, such as more than 500, such as more than 1000, such as more than 5000. The pressure data may be sampled, and a sample rate of e.g. 1, 5 or 10 seconds may be used so that pressure data for every 1, 5 or 10 seconds are extracted from the database.

The plurality of well pressure data may be processed to obtain a slug amplitude, such as a time-varying slug amplitude, and/or a slug period, such as a time-varying slug period for each slug in the multiphase fluid flow. Thus, the well pressure data as received over the predetermined period of time are processed so as to provide a slug amplitude and/or a slug period for a slug in the multiphase fluid flow, the slug being detected at a given time t.

The slug amplitude and/or slug period are determined from the pressure data. A slug amplitude is a pressure difference and a slug period is a time lag. The slug amplitude and slug period typically varies with time, so that a slug amplitude at a time $t_1$ and a slug amplitude at a subsequent time $t_2$ are different.

In one or more embodiments, the processing of the plurality of well pressure data comprises the steps of identifying in the plurality of well pressure data a plurality of well pressure maxima and/or a plurality of well pressure minima, deriving a pressure difference between subsequent well pressure maxima and well pressure minima to determine time-varying slug amplitudes, and/or deriving a time lag between two subsequent well pressure maxima and/or well pressure minima to determine time-varying slug periods. Thus, the slug amplitude may be determined as the pressure difference between a maximum pressure value and a subsequent minimum pressure value, a time $\Delta t$ may lapse from the time t' at which the maximum pressure is measured to the time t" at which the minimum pressure is measured. The slug amplitude varies with time corresponding to the variations over time in the pressure data. The slug period may be determined as the time lag between a first maximum pressure value and a subsequent maximum pressure value (or pressure minimum, respectively). The slug period varies with time corresponding to the variations over time in the pressure data.

The slug amplitude and slug period may, additionally or alternatively, be determined by fitting a function to the pressure data as a function of time, such as a wavelet function, etc. The processing of the plurality of well pressure data may comprise the steps of analysing the plurality of well pressure data using a Wavelet transform to determine a representation of the well pressure data, and deriving time-varying slug amplitude and/or the time-varying slug period from the representation of the well pressure data.

The analysis of the time-varying slug amplitude and/or the time-varying slug period may provide a measure of well performance. The measure may be any measure, and may comprise a slug amplitude distribution and/or a slug period distribution over the period of time. The distribution of the slug amplitudes and/or slug periods may provide a measure of well performance.

For example, for a number of slug amplitude intervals, the distribution may be the number of slugs with a slug amplitude within the given interval and/or likewise, for a number of slug period intervals, the distribution may be the number of slugs with a slug period within a given interval.

Furthermore, in some embodiments, the method may comprise determining average slug amplitudes and/or average slug periods over a predetermined period of time. The average slug amplitudes and/or average slug periods may provide a measure of well performance.

The determined average slug amplitudes and/or average slug periods may be correlated to well operating parameters. The well operating parameters may be any operating parameters, such as lift gas rate, choke settings, fluid injection rates, gas-liquid ratio, wellhead pressure, downhole pressure, water-cut, water-oil ratio, temperature at wellhead and downhole, etc.

In a further aspect of the present invention, a method of estimating well operating parameters for one or more wells configured to transport a multiphase fluid is provided, wherein pressure measurement equipments, such as pressure gauges, are provided at the one or more wells. The method comprises receiving well pressure data, processing the well pressure data to obtain a slug amplitude, such as a time-varying slug amplitude, and/or a slug period, such as a time-varying slug period, for slugs in the multiphase fluid flow. The method furthermore comprises analysing the time-varying slug amplitudes and/or the time-varying slug periods over a period of time to thereby estimate operating parameters, for example to hereby determine a measure of well performance.

The correlation with well operating parameters may be used in numerous ways, for example to validate well test data, for elimination of error sources in well testing, for correlating time-variant slug properties, such as slug amplitude and/or slug period, with measured well performance data, etc.

Any determined parameters, including slug amplitudes, slug periods, determined distribution(s), average values of slug amplitude, average values of slug period, number of slugs, measure of well performance, etc. may be stored in a further database. The determined parameters may be stored for each well, for a plurality of wells, for an oil field, etc. The further database may be the database for storing the pressure data or the further database may be a separate database.

In one or more embodiments, the determined measure of well performance may be compared with a previous measure of well performance, and if the difference between the determined measure and the previous measure fulfils a threshold criterion, then at least one action to investigate the cause of the difference may be performed. The threshold criterion may for example comprise a threshold value in one or more of the determined parameters, for example so that the criterion is fulfilled if a change is larger than a threshold change, the threshold criterion may comprise a function of any of the determined parameters, such as for example a slug amplitude function.

Furthermore, the measure of well performance for the at least one well may be compared with a reference measure of well performance for the at least one well.

The determined measure(s) of well performance may be stored in a database comprising previously determined measures of well performance for the at least one well.

In some embodiments, the determined measure of well performance may be displayed to provide an overview of well performance, the display may display current and previous determined measures of well performance and/or any reference measures of well performance. The display may display the determined measure of well performance for one or more wells, such as for an oil field.

In one or more embodiments, the determined slug amplitude distribution may be compared with a previous slug amplitude distribution, likewise, the determined slug period distribution may be compared with a previous slug period distribution to provide a difference. The difference may be compared to a threshold criterion, and if the threshold criterion is fulfilled, then at least one action to investigate the cause of the difference may be performed.

The action to investigate the cause of the difference may comprise prioritising the well in a well test schedule, receiving additional measurements from the well system, taking a correcting action, etc.

Typically, a number of wells are connected to a common production manifold and the individual wells may be routed to testing according to a predetermined schedule or the decision to route a given well to the test separator may be triggered by a deliberate change in operating conditions, such as a change of lift gas rate, a new wellhead choke setting, re-opening of the well after a shut-in period, etc. Often, however, the well is being tested simply because it is the next well on the testing schedule. Obviously, the more wells connected to the same test separator, the less frequent the measurement of their actual performance will be since each well must be tested individually, and since the duration of a test varies from e.g. 6 to 24 hours depending on how quickly the flow rates stabilise in the test separator. If the testing reveals that the well performance is unchanged, testing the well was unnecessary. On the other hand, if a well turns out to be problematic, a long time may have passed since the last testing of that well.

It is therefore a significant advantage that a measure of well performance may be provided which is independent of well testing results. It is a further advantage that the measure of well performance may be used to trigger a decision to route the well in question to testing, such as to the test separator.

In some embodiments, the invention may further comprise determining a number of slugs over a predetermined period of time and the measure of well performance may be further dependent on the number of slugs.

The method may further comprise controlling well operating parameters in response to the determined measure of well performance.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will, thus, not be described in detail with respect to the description of each figure.

DETAILED DESCRIPTION OF THE DRAWING

Figure 1:
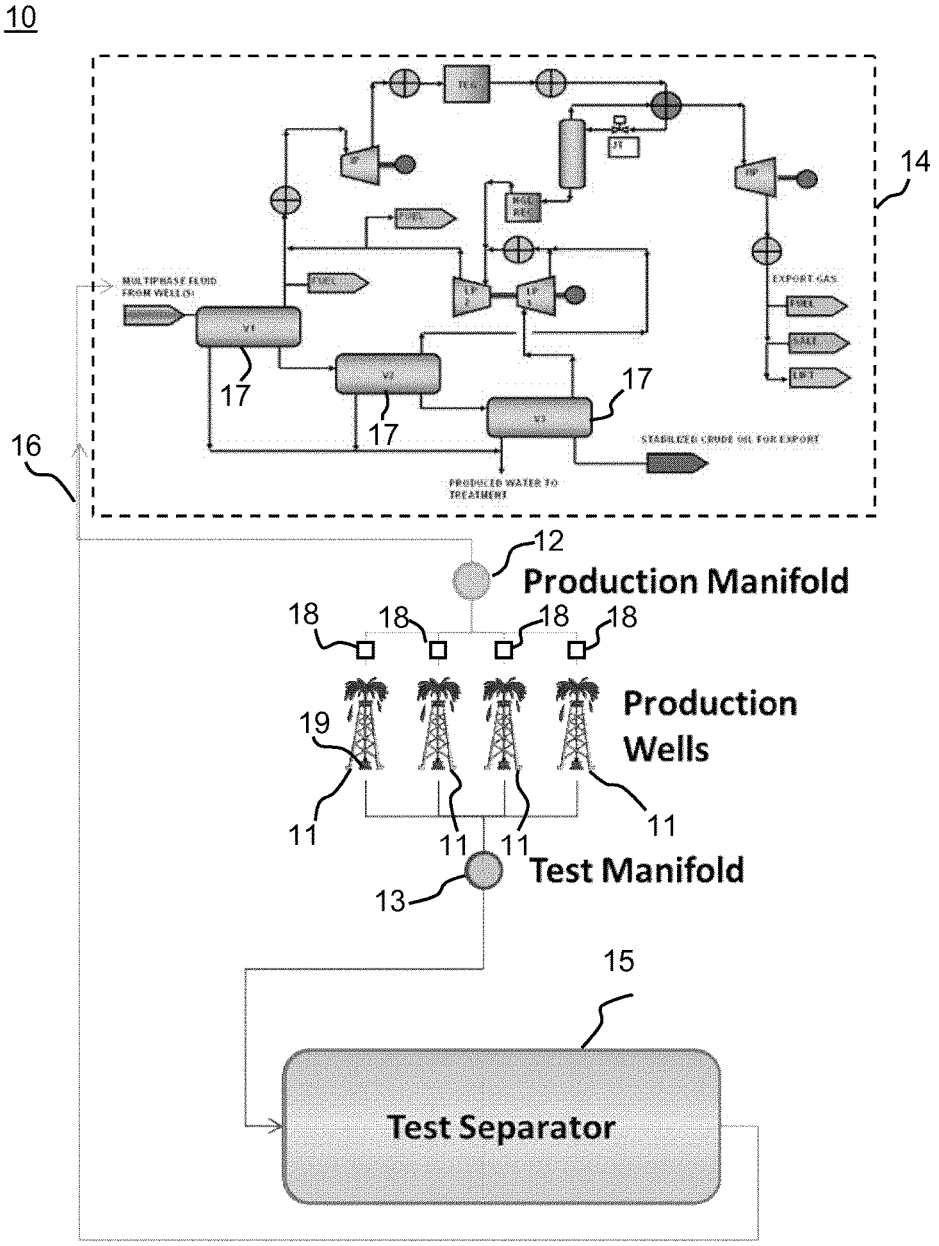
FIG. 1 shows schematically an oil field.

In FIG. 1 a schematic illustration of an oil field 10 is provided. A plurality of oil wells 11 are hooked up to a common production manifold 12 which directs the multiphase fluid flow being a commingled flow of water, oil and gas from the wells 11 via pipes 16 to an oil processing facility 14 comprising a number of separators 17, each operating at distinct pressure and temperature.

The oil field is equipped with a test separator 15 to which each of the wells 11 can be routed individually via test manifold 13 to extract information about the present production state of the well 11 being tested. Each oil well 11 is provided with a pressure gauge 18 at the wellhead 19 for measuring the pressure of the multiphase fluid flow at the wellhead.

Figure 2:
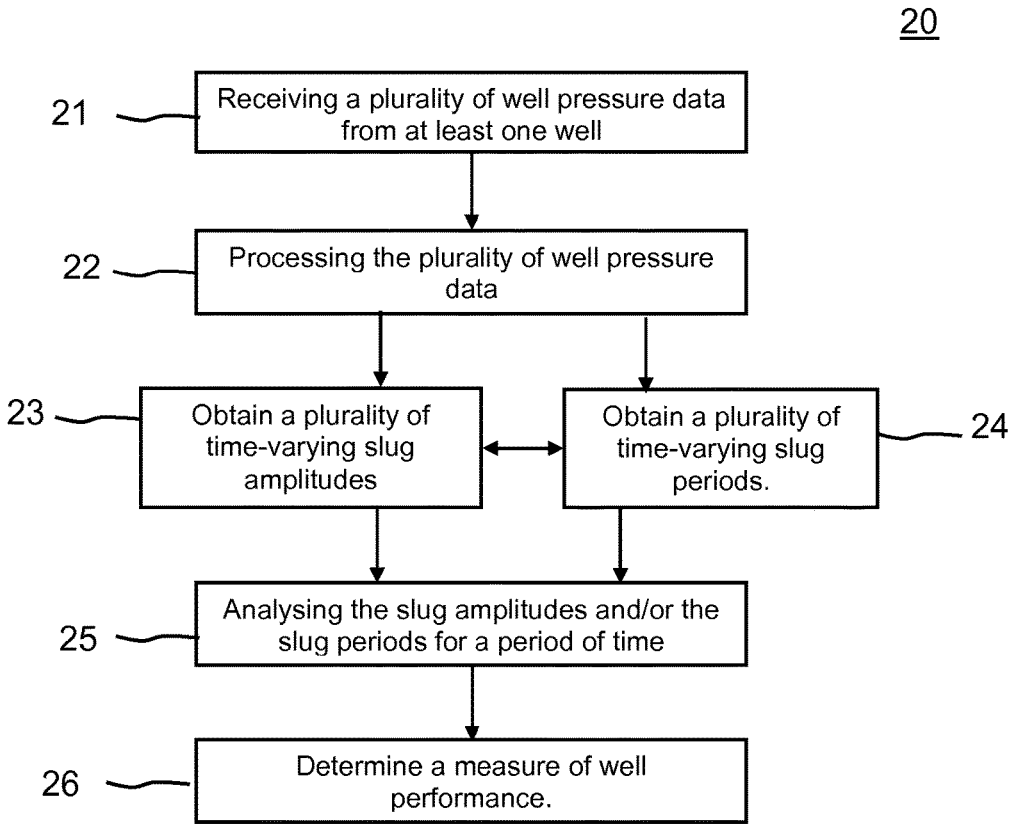
FIG. 2 is a flow chart of a method of analysing multiphase fluid flow.

FIG. 2 shows a flow chart of a method 20 for analysing a multiphase fluid flow in a well 11. In step 21, a plurality of well pressure data are received from at least one well, in step 22, the plurality of well pressure data are processed and in step 23, a plurality of time-varying slug amplitudes are obtained, and in step 24, a plurality of time-varying slug periods are obtained. In step 25, the slug amplitudes and/or the slug periods are analysed for a period of time to thereby, in step 26, determine a measure of well performance.

Figure 3:
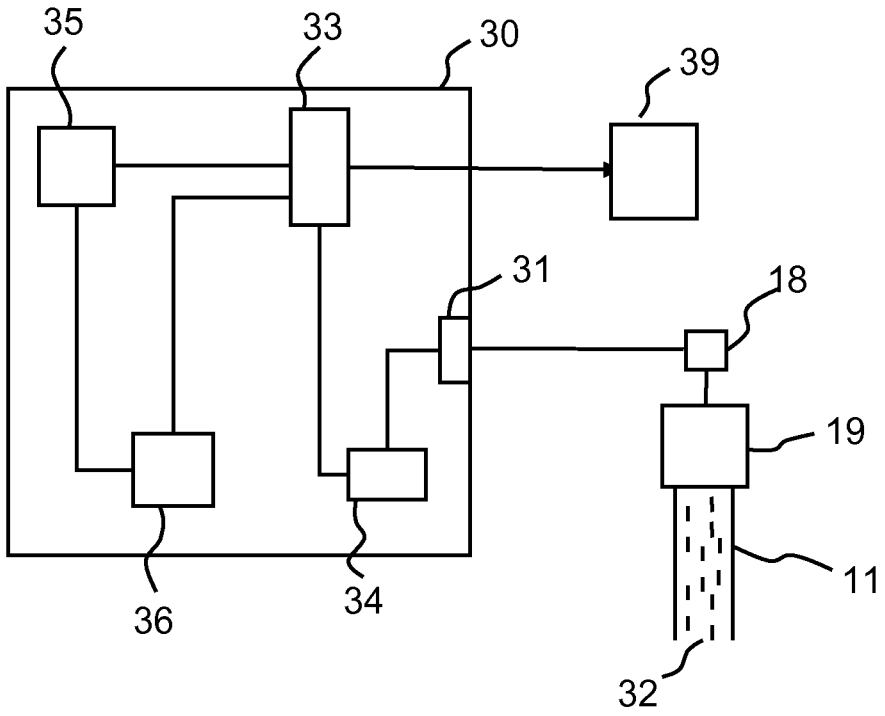
FIG. 3 shows schematically a system for analysing multiphase fluid flow.

FIG. 3 shows a system for analysing a multiphase fluid flow. Pressure measurements are in the present case received by interface 31. The well pressure measurements are received from pressure gauge 18 mounted on wellhead 19. The well 11 transports a multiphase fluid 32, i.e. a fluid comprising oil, water and gas. The well pressure measurements may be received from one well or they may be received for a plurality of wells, such as for a number of wells in an oil field, such as for all wells in an oil field.

The well pressure data as received by the interface 31 are processed in processor 33 to obtain a time-varying slug amplitude and a time-varying slug period for slugs in the multiphase fluid flow. The time-varying slug amplitudes and/or the time-varying slug periods are analysed by the same or a further processor 33 over a period of time to determine a measure of well performance. The measure of well performance may be outputted via an output 35, such as an interface, such as a display. The well measurement data may be stored in storage 34, and the storage 34 may be a database. Thus, the processor 33 may obtain the well pressure data from database 34. The measure of well performance may be provided directly to display 35. The output 35 may display the measure of performance for one well at a time, or the output may display the measure of well performance for a plurality of wells. Alternatively or additionally, the measure of well performance may be provided to an oil field unit. 39 The oil field unit 39 may be any unit collecting measures of well performance and may be comprise a display for displaying the measure of well performance for one or more oil fields. The oil field unit 39 may be configured to receive the control signal from the multiphase fluid flow analysing system 39, and furthermore be configured to schedule a well for testing in response to the received control signal from the multiphase fluid flow analysing system.

Figure 4:
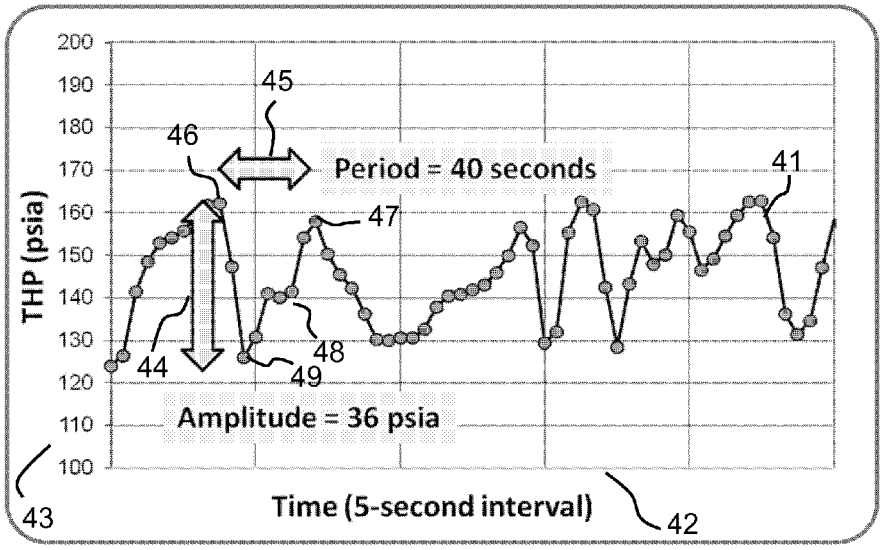
FIG. 4 shows a graph of pressure measurements

The determined slug amplitude and slug period along with determined measures of well performance may be stored in a further database 36. The database 36 may store past, previous and/or historic measures of well performance as well as determined slug amplitudes and slug periods, including slug amplitude and slug period averages and distributions. The data from the database 36 may also be displayed or outputted to output 35. The data may be fed to an oil field unit In FIG. 4, a graph of pressure measurements is shown. The pressure measurements 41 are plotted with 5 sec time intervals on the x-axis 42 with the pressure as measured at the wellhead (THP) along the y-axis 43. It is seen that the pressure measurements 41 oscillate with a non-periodic amplitude and period, and thus the oscillations in the pressure measurement have time-varying amplitudes and periods. Each oscillation from a pressure maximum to the next pressure maxima may represent a slug in the multiphase fluid flow.

An amplitude of an oscillation, and thus of a slug, is defined here as the distance between a pressure maxima and the subsequent in time pressure minima, and the period is described as the time difference between two subsequent maxima or two subsequent minima. For example for oscillation, or slug, 48, the amplitude 44 is the difference between the pressure maxima 46 and the subsequent pressure minima 49 and as illustrated in the graph the amplitude is 36 psia. The period 45 of the slug 48 is the time difference between the pressure maxima 46 and the subsequent pressure maxima 47.

As illustrated in the graph, the period 45 of slug 48 is 40 seconds. It is seen that the time period and the amplitude varies over time, and that in the graph the period varies between approx. 5 sec and 85 sec., and the amplitude varies between approx. 5 psia and 40 psia.

Figure 5:
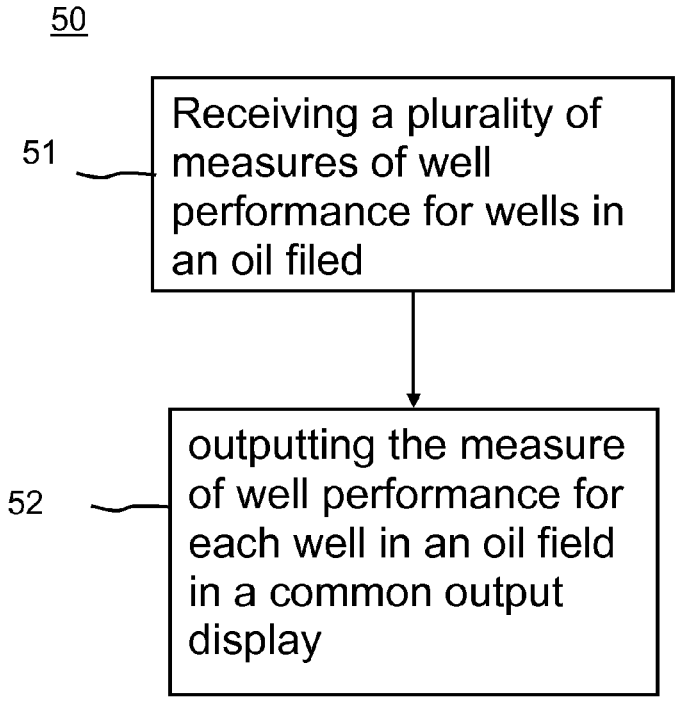
FIG. 5 is a flow chart of a method of monitoring an oil field

FIG. 5 is a flowchart of a method 50 of monitoring an oil field 10 comprising a plurality of wells 11, 112, each well having at least one pressure gauge 18 installed to measure a well pressure and being connected to a multiphase fluid flow analysing system 30. The method comprises in step 51 receiving measurements of well performance from the multiphase fluid flow analysing system for each of the plurality of wells, and, in step 52, outputting the measures of well performance for each of the plurality of wells.

Figure 6A:
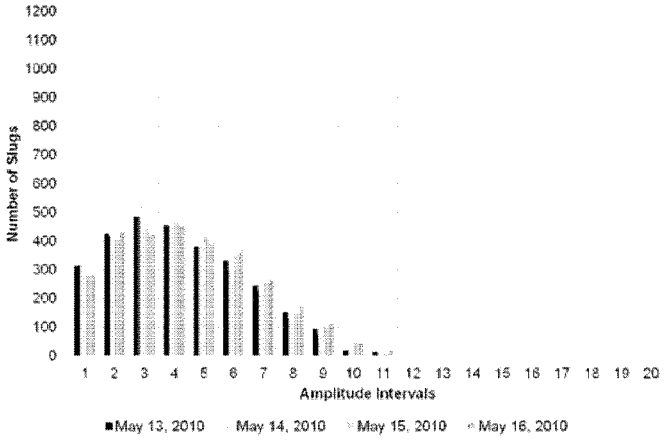
FIGS. 6*a*-6*c* shows an amplitude distribution of the number of slugs.
Figure 6B:
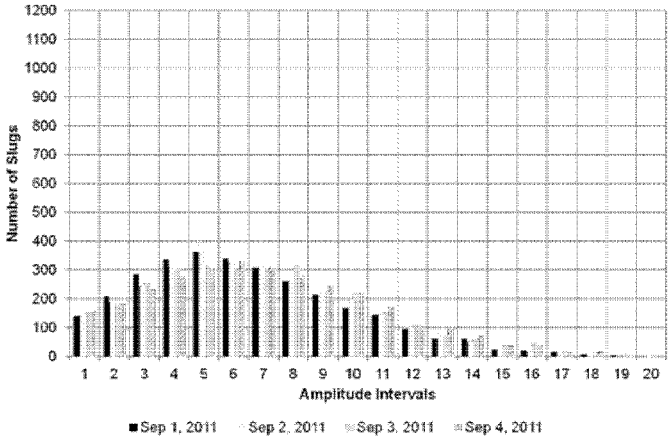
Figure 6C:
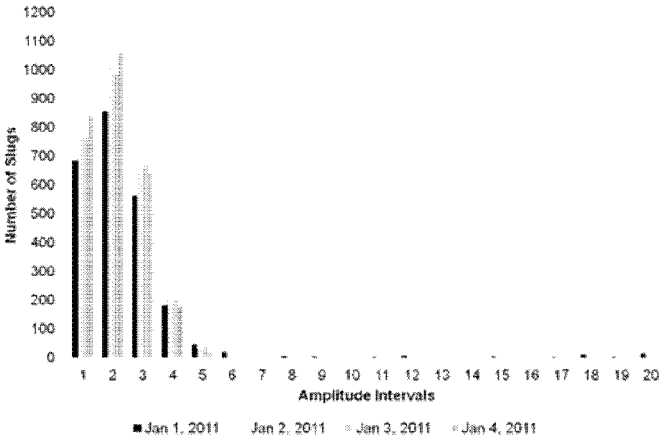

FIGS. 6*a* to 6*c* shows an amplitude distribution of the number of slugs measured over a predetermined period of time. As is seen in the figures, in this specific embodiment, the predetermined period of time is one day, such as 24 hours, and different patterned columns represent different subsequent days. The amplitude intervals may be random and may be selected so as to represent the data in a suitable way. FIG. 6*a* shows an amplitude distribution over a first number of periods of time, in this case a number of days in May 2010, and it is seen that the distribution is substantially unchanged over the number of days. FIG. 6*b* shows an amplitude distribution covering a second number of periods of time, i.e. 4 days in January 2011, and FIG. 6*c* shows an amplitude distribution covering a third number of periods of time, i.e. 4 days in September 2011. It is seen that the amplitude distributions for each number of periods of time are substantially the same. Thus, it seems that the amplitude distribution is periodic when the time intervals are selected to be long, i.e. longer than a few minutes or hours. However, it is also seen that the amplitude distribution in one number of periods of time is significantly different from the amplitude distribution in another number of periods of time. It has been found that the amplitude distribution is one measure of well performance in that a change, such as a significant change, in amplitude distribution may indicate a change in operation conditions and thus lead to an action being performed, such as to schedule the well for testing.

The change in amplitude which may indicate a change in operation conditions may be an amplitude which is outside the expected range, such as a number of slugs in one or more amplitude intervals being significantly different from the expected number, such as being outside a confidence interval, such as a 95% confidence interval. Also, a change in amplitude distribution may indicate a change in operation conditions, and the change may be recorded in any way, such as calculating a value for the change in amplitude distribution, such as using any statistical test methods, such as a test for statistical significance, such as maximum mean discrepancy, etc.

Figure 7:
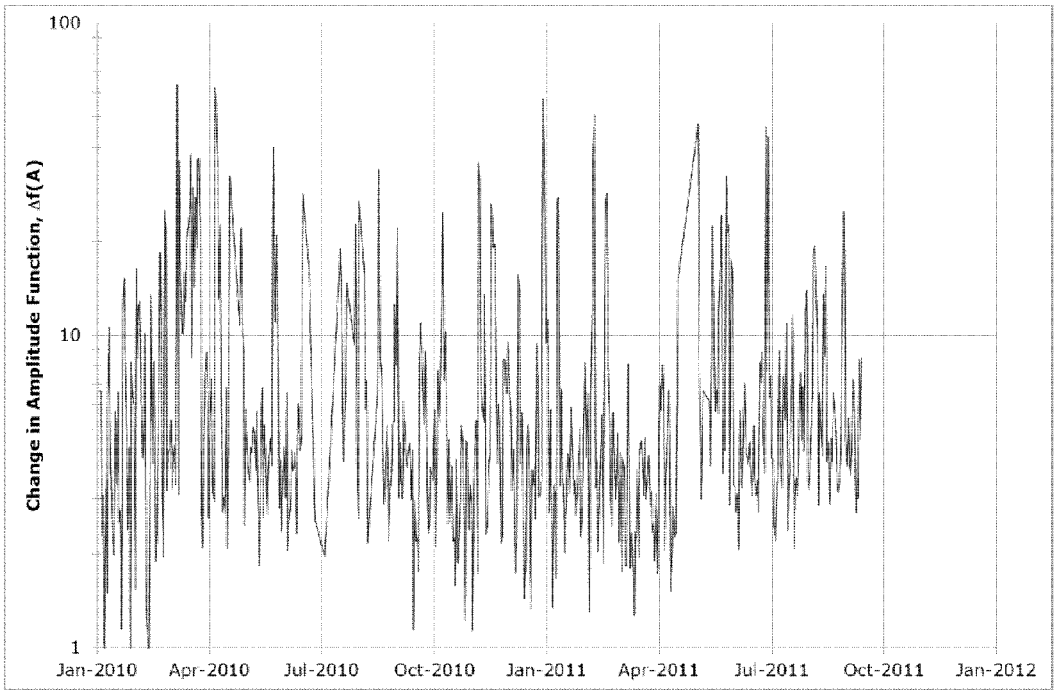
FIG. 7 is a graph showing a change in amplitude function
Figure 8:
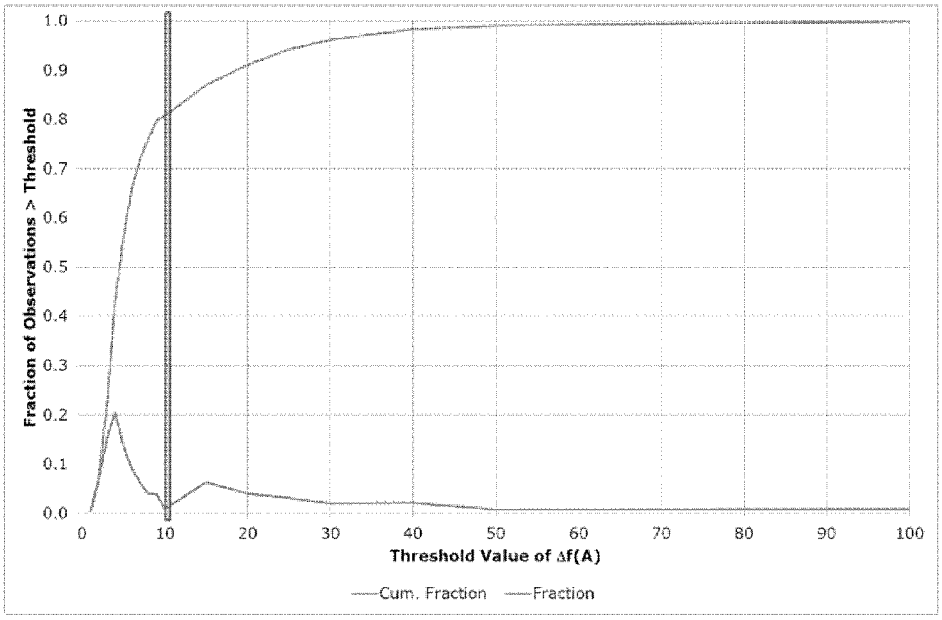
FIG. 8 is a graph showing a threshold criterion

FIG. 7 shows an example of a calculation of a value of a change in amplitude distribution by using an amplitude function Δf(A). The amplitude function Δf(A) calculates a value for the change over a number of periods of time. The change in amplitude function may for example be described as $$\Delta f(A, t_1 \rightarrow t_2) = \frac{\sum_{i=1}^{n_{intervals}} (m_i(t_2) - m_i(t_1))^2}{n_{intervals}}$$

wherein $m_i(t_1)$ is the number of slugs within amplitude interval i at time period $t_1$. A proposed threshold for activating an alert is a difference larger than e.g. 5, such as 10, such as larger than 10, such as larger than 15, etc., depending on the distribution. The fraction of observations larger than the threshold as well as the cumulative fraction is shown in FIG. 8, with a proposed threshold change of 10 for triggering an action or activating an alert.

Figure 9:
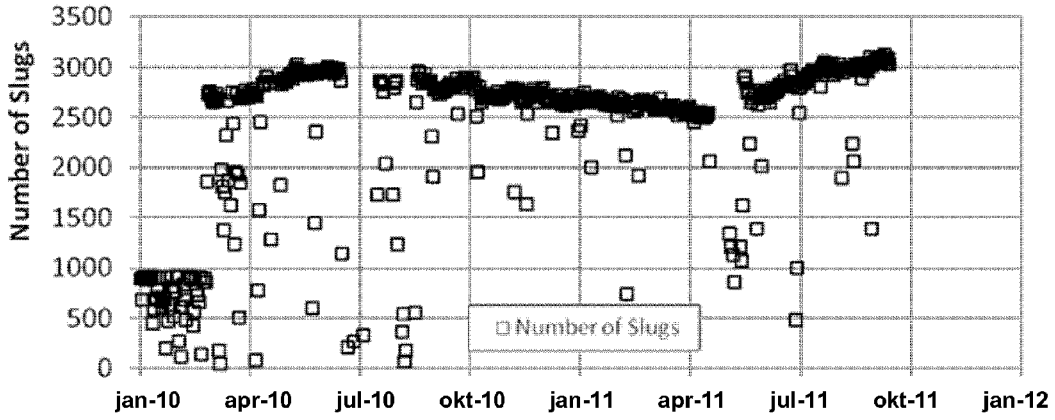
FIG. 9 is a graph showing a number of slugs for an oil well over a period of time.

In FIG. 9, the graph shows a number of slugs for an oil well over a period of time. Thus, a counter counts each slug, i.e. each oscillation in the pressure measurements, so that the number of slugs corresponds to ($N_{pressure\ max/min}-1$), wherein $N_{pressure\ max/min}$ is the number of pressure maxima/pressure minima in the period of time. It is seen that the number of slugs as averaged over a first time period of 1 day is substantially constant over a second period of time.

Figure 10A:
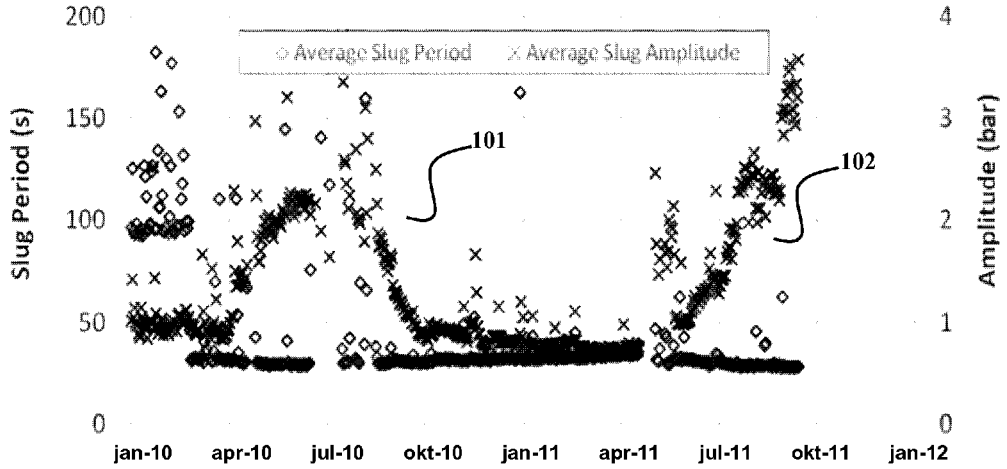
FIG. 10*a* is a graph showing average amplitude and slug period values for a time interval.

In FIG. 10*a*, the graph shows the average slug amplitude over a second period of time. The average slug amplitude is determined as an average of the slug amplitudes as determined by processing the plurality of well measurement data during a first period of time, such as a day of 24 hours.

Figure 10B:
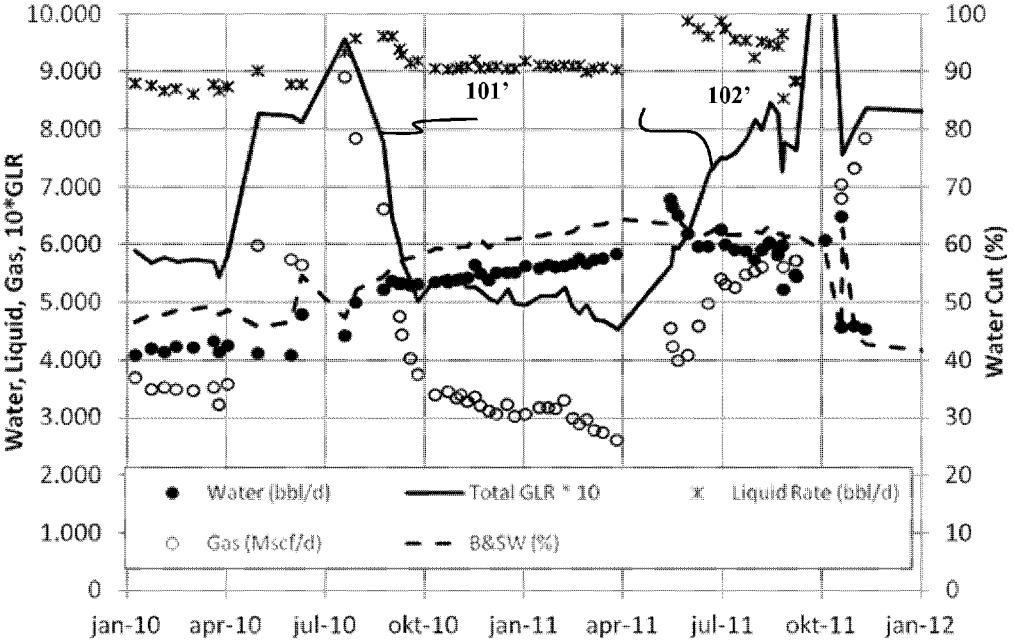
FIG. 10*b* is a graph showing well operating parameters production parameters for the time interval.

FIG. 10*b* shows corresponding measurement data for the well from which the well measurement data are received. Different well operating parameters are shown to include oil, water, liquid, lift gas, gas, 10×GLR, where GLR is the gas liquid ratio, i.e. the amount of gas relative to the amount of oil and water in the multiphase fluid. It is seen that from April 2010 to October 2010, an increase 101' in gas, and thus in GLR, is seen. As seen from FIG. 10*a*, a corresponding increase in average daily amplitude 101 is seen in the same period of time. Also, from May 2011 to October 2011, an increase in average daily amplitude 102 is seen to correlate with an increase 102' in gas and thus in GLR. Thus, it is seen that a measure of well performance may be achieved from the average daily slug amplitude. By correlating the average daily slug amplitude with the operating parameters, further information about well performance may hereby be achieved.

Figure 11:
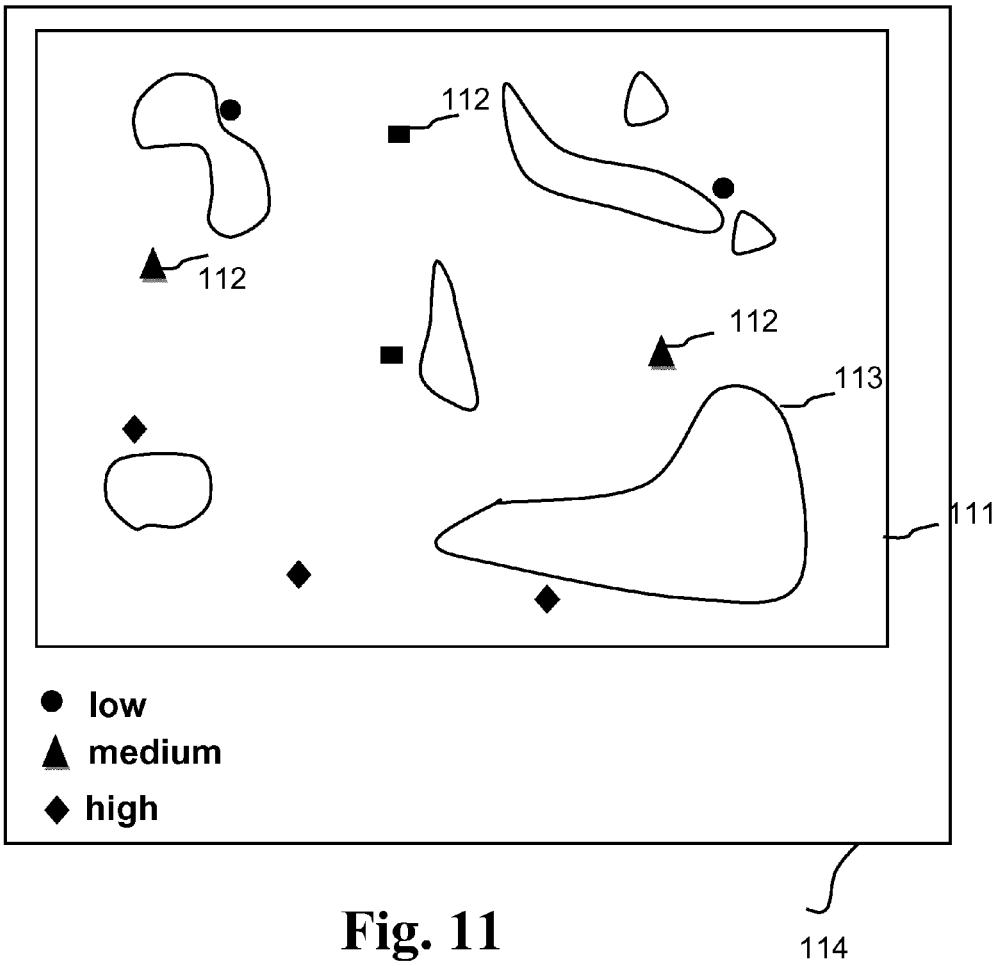
FIG. 11 shows schematically an oil field monitoring display.

FIG. 11 shows an output or an interface 114 of an oil field monitoring system. The display shows an oil field 111 comprising a number of reservoirs 113 and a plurality of wells 112. The display 114 shows a measure of well performance for each of the wells 112, indicating in this case, a low (dot), a medium (square) or a high (diamond) well performance. This may indicate pressure, average amplitude, average slug period, etc.

Although particular embodiments of the present inventions have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents. Furthermore, it will be appreciated that embodiments described in connection with one of the aspects described herein may equally be applied to the other aspects.

LIST OF REFERENCES

10, 111 oil field
11, 112 oil wells
12 common production manifold
13 test manifold
14 oil processing facility
15 test separator
16 pipes
17 separators
18 pressure gauges
19 wellhead
30 flow analysing system
31 interface
32 multiphase fluid
33 processor
34 storage
35 output
36 database
39 oil field unit
41 pressure measurements
42 x-axis
43 y-axis
44 amplitude
45 period
46 pressure maxima
49 pressure minima
48 oscillation (slug)
101', 102' increase in gas
101, 102 increase in average daily amplitude
113 reservoirs
114 output of oil field monitoring system

The invention claimed is:

1. A method of analysing multiphase fluid flow in at least one well, the method comprises:

receiving in a storage a plurality of well pressure data from at least one pressure gauge installed on the at least one well;

processing using a processor the plurality of well pressure data to obtain a time-varying slug amplitude and a time-varying slug period for slugs in the slug flow;

analyzing, using the processor, the slug amplitudes and/or the slug periods over a period of time to thereby determine a measure of well performance to thereby characterise slug flow in the multiphase fluid flow, wherein the measure comprises a slug amplitude distribution and/or a slug period distribution over the period of time and/or wherein the measure comprises a slug amplitude average and/or a slug period average, determining average slug amplitudes and/or average slug periods over a predetermined period of time; and correlating the determined average slug amplitudes and/or average slug periods to well operating parameters, wherein the well operating parameters comprise lift gas rate, choke settings, fluid injection rates, gas-liquid ratio, wellhead pressure, downhole pressure, water-cut, water-oil ratio, temperature at wellhead and downhole;

controlling an oil field unit to schedule the at least one well for testing via a test manifold based on the determined measure of well performance, wherein scheduling based on the determined measure reduces an amount of time required to identify poorly performing wells;

routing, via the test manifold and according to the schedule, the at least one well to a test separator for testing.

2. The method according to claim 1, wherein the determined measure of well performance is compared with a previous measure of well performance, and if the difference between the determined measure and the previous measure fulfils a threshold criterion, perform at least one action to investigate the cause of the difference.

3. The method according to claim 2, wherein the action comprises prioritising the well in a well test schedule, receiving additional measurements from a well system, and taking a correcting action.

4. The method according to claim 1, wherein the method further comprises:

determining a difference between the determined slug amplitude distribution and/or slug period distribution and a previous slug amplitude distribution and/or slug period distribution; and if the difference fulfils a threshold criterion, prioritizing the at least one well to be tested before a second well in the well test scheduling.

5. The method according to claim 1, wherein the processing of the plurality of well pressure data comprises the steps of identifying in the plurality of well pressure data a plurality of well pressure maxima and a plurality of well pressure minima, deriving a pressure difference between subsequent well pressure maxima and well pressure minima to determine time-varying slug amplitudes, and/or—deriving a time lag between two subsequent well pressure maxima and/or well pressure minima to determine time-varying slug periods.

6. The method according to claim 1, wherein the processing of the plurality of well pressure data comprises the steps of analysing the plurality of well pressure data using a Wavelet transform to determine a representation of the well pressure data, and deriving time-varying slug amplitude and/or time-varying slug period from the representation of the well pressure data.

7. The method according to claim 1, wherein the method further comprises comparing the measure of well performance for the at least one well with a reference measure of well performance for the at least one well and/or wherein the determined measure of well performance is stored in a database comprising previously determined measures of well performance for the at least one well.

8. The method according to claim 1, wherein the multiphase fluid comprises oil, gas, water and solids.

9. The method according to claim 1, wherein the method further comprises determining a number of slugs over a predetermined period of time and wherein the measure of well performance is further dependent on the number of slugs.

10. A non-transitory computer readable medium having stored thereon at least one code section for causing a processor to perform the steps of claim 1.

11. The method according to claim 2, wherein the method further comprises:

comparing the determined slug amplitude distribution and/or slug period distribution with a previous slug amplitude distribution and/or slug period distribution and if the difference fulfils the threshold criterion, prioritising the at least one well in the well test scheduling; and/or determining average slug amplitudes and/or average slug periods over a predetermined period of time and correlating the determined average slug amplitudes and/or average slug periods to well operating parameters.

12. The method according to claim 2, wherein the processing of the plurality of well pressure data comprises the steps of identifying in the plurality of well pressure data a plurality of well pressure maxima and a plurality of well pressure minima, deriving a pressure difference between subsequent well pressure maxima and well pressure minima to determine time-varying slug amplitudes, and/or—deriving a time lag between two subsequent well pressure maxima and/or well pressure minima to determine time-varying slug periods.

13. The method according to claim 2, wherein the processing of the plurality of well pressure data comprises the steps of analysing the plurality of well pressure data using a Wavelet transform to determine a representation of the well pressure data, and deriving time-varying slug amplitude and/or time-varying slug period from the representation of the well pressure data.

14. The method according to claim 2, wherein the method further comprises comparing the measure of well performance for the at least one well with a reference measure of well performance for the at least one well and/or wherein the determined measure of well performance is stored in a database comprising previously determined measures of well performance for the at least one well.

15. A system for analysing a multiphase fluid flow in at least one well transporting multiphase fluids, each well having at least one pressure gauge configured to measure well pressure, the system comprises:

a processor configured to:

receive well pressure data;

process the well pressure data to obtain a time-varying slug amplitude and a time-varying slug period for slugs in the multiphase fluid flow;

analyse the time-varying slug amplitudes and/or the time-varying slug periods over a period of time to thereby determine a measure of well performance, wherein the measure comprises a slug amplitude distribution and/or a slug period distribution over the period of time and/or wherein the measure comprises a slug amplitude average and/or a slug period average;

determine average slug amplitudes and/or average slug periods over a predetermined period of time;

correlate the determined average slug amplitudes and/or average slug periods to well operating parameters, wherein the well operating parameters comprise lift gas rate, choke settings, fluid injection rates, gas-liquid ratio, wellhead pressure, downhole pressure, water-cut, water-oil ratio, temperature at wellhead and downhole;

control an oil field unit to schedule the at least one well for testing via a test manifold based on the determined measure of well performance, wherein scheduling based on the determined measure reduces an amount of time required to identify poorly performing wells; and routing, via the test manifold and according to the schedule, the at least one well to a test separator for testing.

16. The system according to claim 15, the system further comprising a database for receiving well pressure data from the at least one pressure gauge for the at least one well, the processor configured to receive the well pressure data from the database.

17. The system according to claim 16, further comprising a control unit configured to compare the determined measure of well performance with a previous measure of well performance, and, if the difference between the determined measure and the previous measure fulfils a threshold criterion, to provide a control signal indicating that an action should be performed.

18. A well system comprising one or more wells, each well having at least one pressure gauge installed to measure a well pressure;

a common production manifold configured to receive well production output from the one or more wells;

a test manifold configured to receive well production output from one of the one or more wells; and a multiphase fluid flow analysing system according to claim 15; and an oil field unit being configured to receive the control signal from the multiphase fluid flow analysing system, wherein the oil field unit is configured to schedule a well for testing in response to a received control signal from the multiphase fluid flow analysing system.

19. An oil field monitoring system for an oil field comprising a plurality of wells, each well having at least one pressure gauge installed to measure a well pressure and being connected to a multiphase fluid flow analysing system according to claim 15, the oil field monitoring system comprising:

an oil field unit being configured to receive the measure of well performance from the multiphase fluid flow analysing system for each of the plurality of wells; and an interface for outputting the measures of well performance for each of the plurality of wells.

* * * * *